US005400434A

United States Patent [19]

Pearson

[11] Patent Number: 5,400,434

[45] Date of Patent: Mar. 21, 1995

[54] VOICE SOURCE FOR SYNTHETIC SPEECH SYSTEM

[75] Inventor: Steve Pearson, Santa Barbara, Calif.

[73] Assignee: Matsushita Electric Industrial Co., Ltd., Osaka Kadoma, Japan

[21] Appl. No.: 228,954

[22] Filed: Apr. 18, 1994

Related U.S. Application Data

[63] Continuation of Ser. No. 33,951, Mar. 19, 1993, abandoned, which is a continuation of Ser. No. 578,011, Sep. 4, 1990, abandoned.

[51] Int. Cl.[6] ..... G10L 5/02

[52] U.S. Cl. ..... 395/2.73; 395/2.76; 395/2.77

[58] Field of Search ..... 395/2, 2.67, 2.7, 2.73, 395/2.76, 2.77, 2.75; 381/51-53

[56] References Cited

U.S. PATENT DOCUMENTS

| | | | |
|---|---|---|---|
| 4,278,838 | 7/1981 | Antonov | 381/52 |
| 4,301,328 | 11/1981 | Dorais | 381/51 |
| 4,586,193 | 4/1986 | Seiler et al. | 381/51 |
| 4,624,012 | 11/1986 | Lin et al. | 381/51 |
| 4,692,941 | 9/1987 | Jacks et al. | 381/52 |
| 4,709,390 | 11/1987 | Atal et al. | 381/51 |
| 4,829,573 | 5/1989 | Gagnon et al. | 381/53 |
| 5,163,110 | 11/1992 | Arthur et al. | 395/2 |

OTHER PUBLICATIONS

Computer, Aug. 1990, Michael H. O'Malley, Text-to-Speech Conversion Technology.

Robotics Manufacturing, Nov. 1989, International Association of Science and Technology for Development, Modern Developments in Text-to-Speech—Towards Achieving Naturalness.

IEEE Transactions on Audio and Electro Acoustics, vol. AU-21, No. 3, Jun. 1973, John N. Holmes, The Influence of Glottal Waveform on Nat. of Speech.

Journal of Speech and Hearing Research, vol. 30, 122-129, Mar. 1987 Javkin, Antonanzas-Barroso, Maddieson, Digital Inverse for Linguistic Research.

Journal Acoust. Soc. Am., vol. 87, No. 2, Feb. 1990, Dennis H. Klatt, Laura Klatt, Analysis, Synthesis and Perception of Voice Quality Var. Among Male and Female Talkers.

J. Acoust. Soc. Am., vol. 82, No. 3, Sep. 1987, Dennis Klatt, Review of Text-to-Speech Conversion for English.

*Primary Examiner*—David D. Knepper

*Attorney, Agent, or Firm*—Price, Gess & Ubell

[57] ABSTRACT

The voice source for the synthetic speech system is human generated speech waveforms that are inverse filtered to produce glottal waveforms representing larynx sound. These glottal waveforms are modified in pitch and amplitude, as required, to produce the desired sound. The human quality of the synthetically generated voice is further brought out by adding vocal tract effects, as desired. The pitch control is effected in one of two alternate ways, a loop method, or a concatenation method.

47 Claims, 7 Drawing Sheets

VOICE SOURCE FOR SYNTHETIC SPEECH SYSTEM

This is a continuation of application Ser. No. 08/033,951, filed on Mar. 19, 1993, for a VOICE SOURCE FOR SYNTHETIC SPEECH SYSTEM, now abandoned, which is a continuation of application Ser. No. 07/578,011, filed on Sep. 4, 1990, for a Voice Source for Synthetic Speech System, now abandoned.

BACKGROUND OF THE INVENTION

1. Field of the Invention

The present invention relates generally to improvements in synthetic voice systems and, more particularly, pertains to a new and improved voice source for synthetic speech systems.

2. Description of the Prior Art

An increasing amount of research and development work is being done in text-to-speech systems. These are systems which can take someone's typing or a computer file and turn it into the spoken word. Such a system is very different from the system used in, for example, automobiles that warn that a door is open. A text-to-speech system is not limited to a few "canned" expressions. The commercially available systems are being put to such uses as reading machines for the blind and telephone computer based information.

The presently available systems are reasonably understandable. However, they still produce voices which are noticeably nonhuman. In other words, it is obvious that they are produced by a machine. This characteristic limits their range of application. Many people are reluctant to accept conversation from something that sounds like a machine.

One of the most important problems in producing natural-sounding synthetic speech occurs at the voice source. In a human being, the vocal cords produce a sound source which is modified by the varying shape of the vocal tract to produce the different sounds. The prior art has had considerable success in computationally mimicking the effects of the vocal tract. Mimicking the effects of the vocal cords, however, has proved much more difficult. Accordingly, the research in text-to-speech in the last few years has been largely dedicated to producing a more human-like sound.

The essential scheme of a typical text-to-speech system is illustrated in FIG. 1. The text input 11 comes from a keyboard or a computer file or port. This input is filtered by a preprocessor 15 into a language processing component which attempts a syntactic and lexical analysis. The preprocessor stage section 15 must deal with unrestricted text and convert it into words that can be spoken. The text-to-speech system of FIG. 1, for example, may be called upon to act as a computer monitor, and must express abbreviations, mathematical symbols and, possibly, computer escape sequences, as word strings. An erroneous input such as a binary file can also come in, and must be filtered out.

The output from the preprocessor 15 is supplied to the language processor 17, which performs an analysis of the words that come in. In English text-to-speech systems, it is common to include a small "exceptions" dictionary for words that violate the normal correspondences between spelling and pronunciation. The lexicon entries are not only used for pronunciation. The system extracts syntactic information as well, which can be used by the parser. Therefore, for each word, there are entries for parts of speech, verb type, verb singular or plural, etc. Words that have no lexicon entry pass through a set of letter-to-sound rules which govern, for example, how to pronounce the sequence. The letter-to-sound rules thus provide phoneme strings that are later passed on to the acoustic processing section 19. The parser has an important but narrowly-defined task. It provides such syntactic, semantic, and pragmatic information as is relevant for pronunciation.

All this information is passed on to the acoustic processing component 19, which modifies the phoneme strings by the applicable rules and generates time varying acoustic parameters. One of the parameters that this component has to set is the duration of the segments which are affected by a number of different conditions. A variety of factors affect the duration of vowels, such as the intrinsic duration of the vowels, the type of following consonant, the stress (accent) on a syllable, the location of the word in a sentence, speech rate, dialect, speaker, and random variations.

A major part of the acoustic processing component consists of converting the phoneme strings to a parameter array. An array of target parameters for each phoneme is used to create some initial values. These values are modified as a result of the surrounding phonemes, the duration of the phoneme, the stress or accent value of the phoneme, etc. Finally, the acoustic parameters are converted to coefficients which are passed on to the formant synthesizer 21. The cascade/parallel formant synthesizer 21 is preferably common across all languages.

Working within source-and-filter theory, most of the work on the acoustic and synthesizer portions of text-to-speech systems in the past years has been devoted to improving filter characteristics; that is, the formant frequencies and bandwidths. The emphasis has now turned to improving the characteristics of the voice source; that is, the signal which, in humans, is created by the vocal folds.

In earlier work toward this end, conducted almost entirely on male speech, a reasonable approximation of the voice source, was obtained by filtering a pulse string to achieve an approximately 6 dB-per-octave rolloff. Now that the attention has turned from improving filter characteristics, it has turned to improving the voice source itself.

Moreover, the interest in female speech has also made work on the voice source important. A female voice source cannot be adequately synthesized using a simple pulse train and filter.

This work is quite difficult. Data on a human voice source is difficult to obtain. The source from the vocal folds is filtered by the vocal tract, greatly modifying its spectrum and time waveform. Although this is a linear process which can be reversed by electronic or digital inverse filtering, it is difficult and time consuming to determine the time varying transfer function with sufficient precision to accurately set the inverse filters. However, the researchers have undertaken voice source research despite these inherent difficulties.

FIGS. 2, 3, and 4 illustrate time domain waveforms 23, 25, and 27. These waveforms illustrate the output of inverse filtering for the purpose of recovering a glottal waveform. FIG. 2 shows the original time waveform 23 for the vowel "a." FIG. 3 shows the waveform 25 from which the formants have been filtered. Waveform 25 still shows the effect of lip radiation, which emphasizes high frequencies with a slope of about 60 dB per octave.

Integration of waveform 25 produces waveform 27 (FIG. 4), which is the waveform produced after the lip radiation effect is removed.

A text-to-speech system must have a synthetic voice source. In order to produce a synthetic source, it has been suggested to synthesize the glottal source as the concatenation of a polynomial and an exponential decay, as shown by waveform 29 in FIG. 5. The waveform is specified by four parameters, TO, AV, OQ, and CRF. TO is the period which is the inverse of the frequency FO expressed in sample points. AV is the amplitude of voicing. OQ is the open quotient; that is, the percentage of the period during which the glottis is open. These first three parameters uniquely determine the polynomial portion of the curve. To simulate the closing of the glottis, an exponential decay is used, which has a time constant CRF (corner rounding factor). A larger CRF has the effect of softening the sharpness of an otherwise abrupt simulated glottal closure.

Control of the glottal pulse is designed to minimize the number of required input parameters. TO is, of course, necessary, and is supplied to the acoustic processing component. Target values for AV and for initial values of OQ are maintained in table entries for all phonemes. A set of rules govern the interpolation between the points where OQ and AV are specified.

Voiceless sounds have an AV value of zero. Although the OQ value is meaningless during a voiceless sound, these nevertheless are stored with varying OQ values so that interpolating rules provide the proper OQ for voice sounds in the vicinity of voiceless sounds. CRF is strongly correlated to the other parameters in natural speech. For example, high pitch is correlated with a relatively high CRF. A higher voice pitch is associated with smoother voice quality (low spectral tilt). Higher amplitude correlates with a harsher voice quality (high spectral tilt). A higher open quotient is correlated with a breathy voice, which has a very high CRF.

One of the most important elements in producing natural sounding synthetic speech concerns voice quality, or the "timbre" of the voice. This characteristic is largely determined at the voice source. In a human being, the vocal cords produce the sound source which is modified by the varying shape of the vocal tract to produce different sounds. All prior art techniques have been directed to computationally mimicking the effects of the vocal tract. There has been considerable success in this endeavor. However, computationally mimicking the effects of the vocal cords has proved quite difficult. The prior art approach to this problem has been to use the well-established research technique of taking the recorded speech of a human speaker and removing the effects of the mouth, leaving only the voice source. As discussed above, the voice source was then utilized by extracting parameters, and then using these parameters for synthetic voice generation. The present invention approaches the problem from a completely different direction in that it uses the time waveform of the voice source itself. This idea was explored by John N. Holmes in his paper, *The Influence of Glottal Waveforms on the Naturalness of Speech from a Parallel Formant Synthesizer,* in the IEEE Transactions on Audio and Electroacoustics, Vol. R, AU-21, No. 3, June 1973.

The objective of providing a source signal which is capable of quickly and reliably producing voice quality that is indistinguishable from human voice nevertheless has not been obtained until the present invention.

SUMMARY OF THE INVENTION

The glottal waveform generated from human recorded steady state vowels are stored in digitally coded form. These glottal waveforms are modified to produce the required sounds by pitch and amplitude control of the waveform and the addition of vocal tract effects. The amplitude and duration are modified by modulating the glottal wave with an amplitude envelope. Pitch is controlled in one of two ways, the loop method or concatenation method. In the loop method, a table stores the sample points of at least one glottal pulse cycle. The pitch of the stored glottal pulse is raised or lowered by interpolation between the points stored in the table. In the concatenation method, a library of glottal pulses, each with a different period, is provided. The glottal pulse corresponding to the current pitch value is the one accessed at any given time.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which like reference numerals designate like parts throughout the figures and wherein:

DESCRIPTION OF THE PREFERRED EMBODIMENTS

Figure 1:
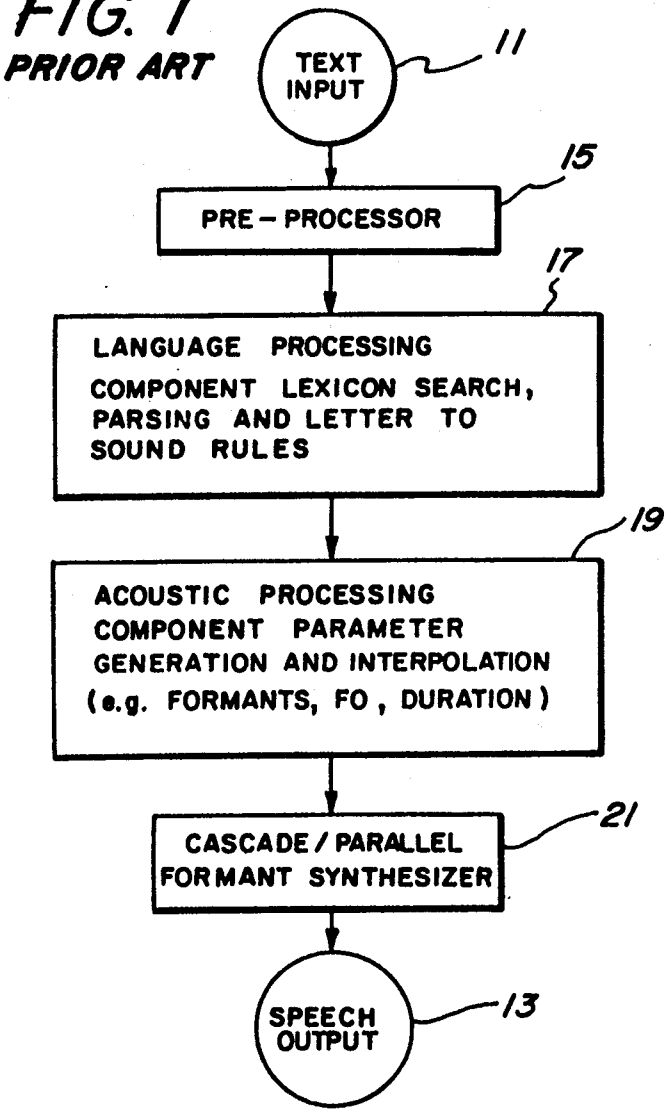
FIG. 1 PRIOR ART
FIG. 1 is a block diagram of a prior art speech synthesizer system.
Figure 2:
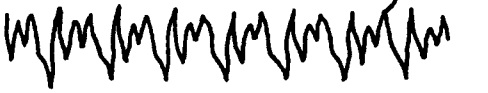
FIGS. 2–4 are time domain waveforms of a processed human vowel sound.
Figure 3:
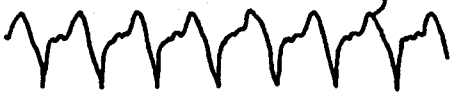
Figure 4:
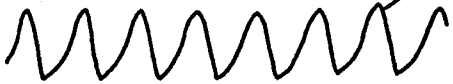
Figure 5:
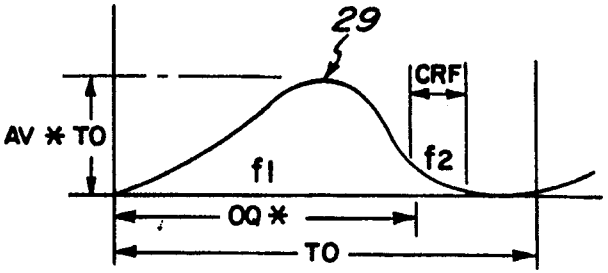
FIG. 5 is a waveform representation of a glottal pulse.
Figure 6:
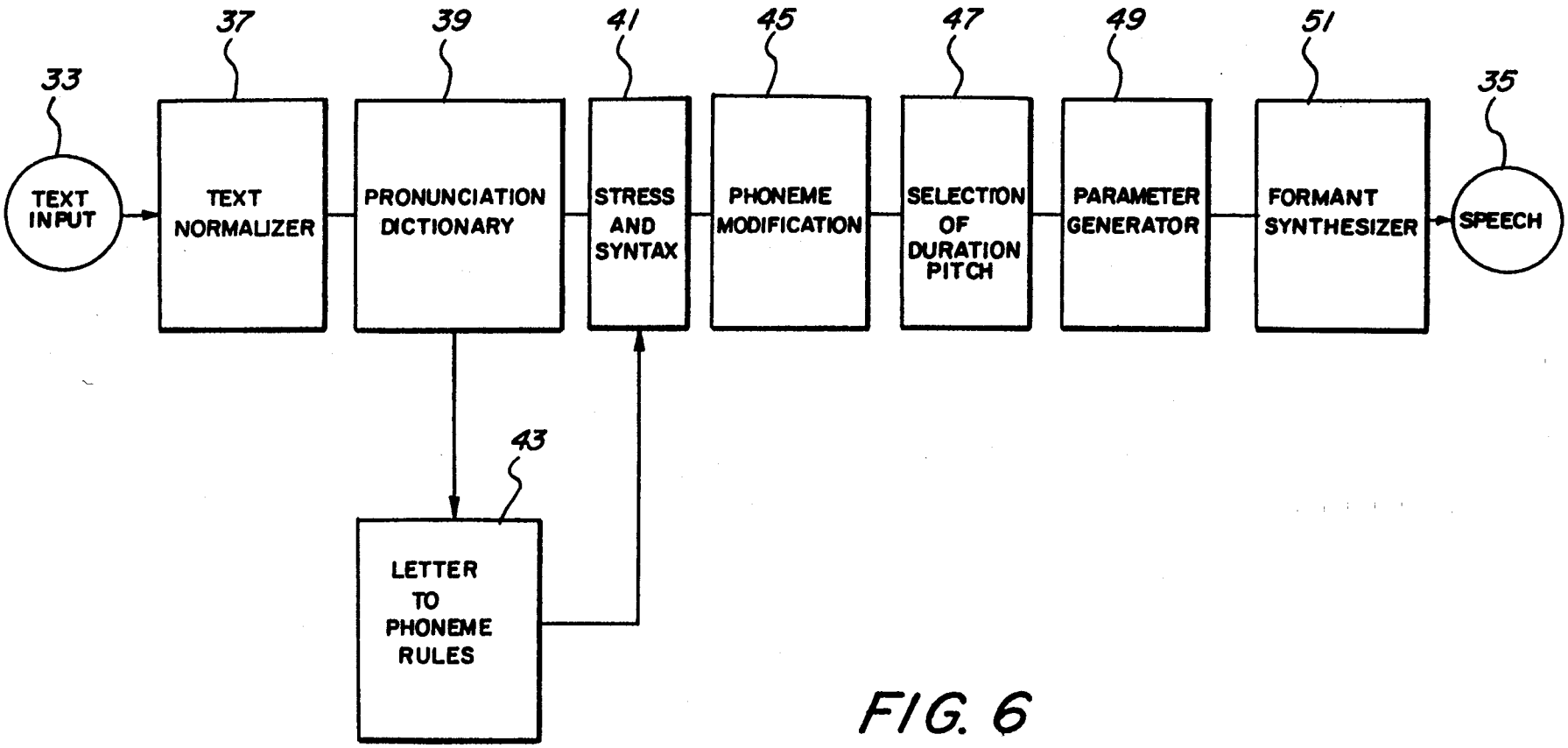
FIG. 6 is a block diagram of a speech synthesizer system.

The present invention is implemented in a typical text-to-speech system as illustrated in FIG. 6, for example. In this system, input can be by written material such as text input 33 from an ASCII computer file. The speech output 35 is usually an analog signal which can drive a loud speaker. The text-to-speech system illustrated in FIG. 6 produces speech by utilizing computer algorithms that define systems of rules about speech, a typical prior art approach. Thus, letter-to-phoneme rules 43 are utilized when the text normalizer 37 produces a word that is not found in the pronunciation dictionary 39. Stress and syntax rules are then applied at stage 41. Phoneme modification rules are applied at stage 45. Duration and pitch are selected at stage 47, all resulting in parameter generation at stage 49, which drives the formant synthesizer 51 to produce the analog signal which can drive the speaker.

In the text-to-speech system of the present invention, text is converted to code. A frame of code parameters is produced every n milliseconds and specifies the characteristics of the speech sounds that will be produced over the next n milliseconds. The variable "n" may be 5, 10, or even 20 milliseconds or any time in between. These parameters are input to the formant synthesizer 51 which outputs the analog speech sounds. The parameters control the pitch and amplitude of the voice, the resonance of the simulated vocal tract, the frication and aspiration.

The present invention replaces the voice source of a conventional text-to-speech system with a voice source generator utilizing inverse filtered natural speech. The actual time domain components of the natural speech wave are utilized.

Figure 7:
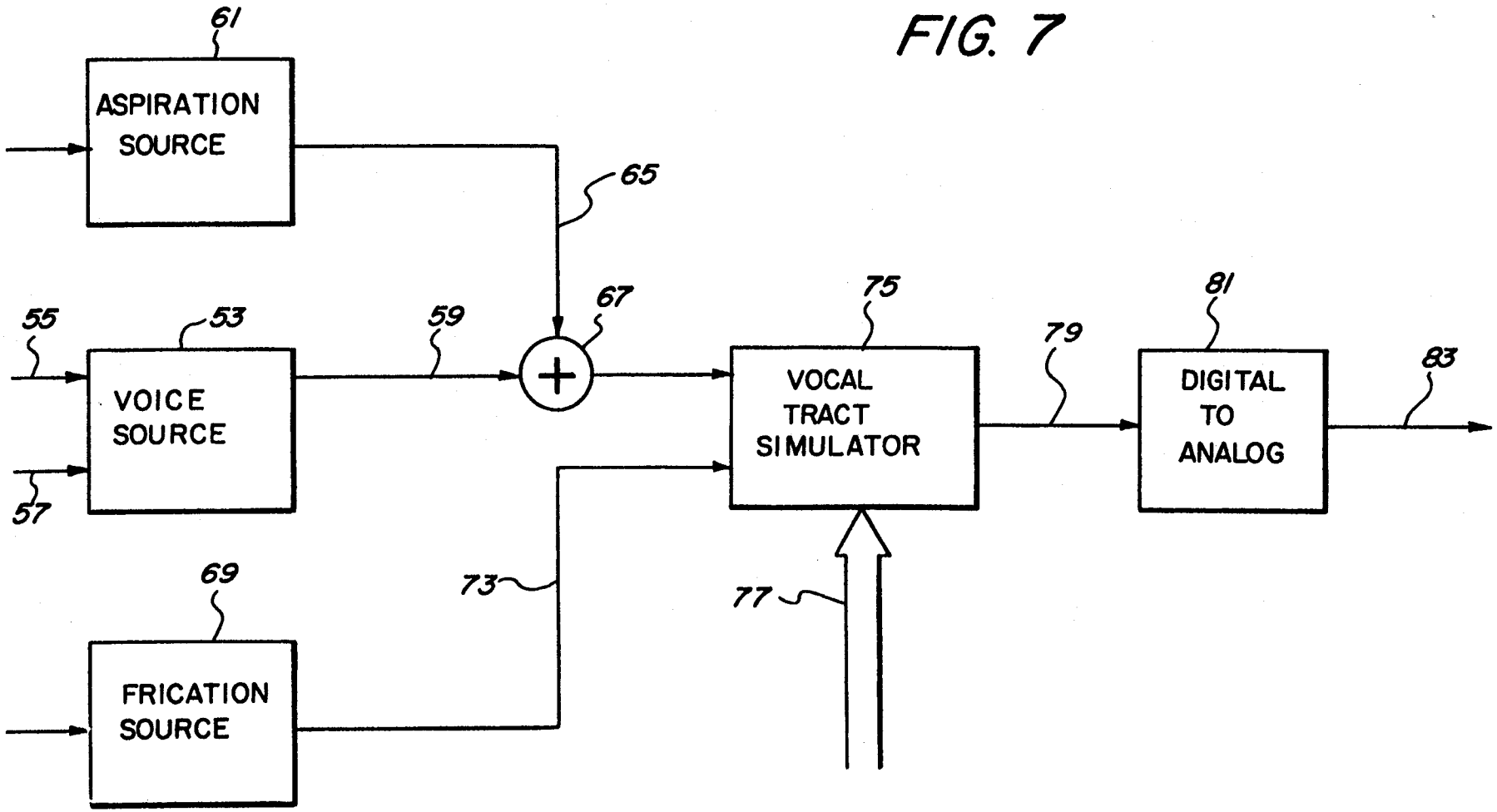
FIG. 7 is a block diagram of a preferred embodiment of the present invention showing the use of a voice source according to the present invention.

A synthesizer embodying the present invention is illustrated in FIG. 7. This synthesizer converts the received parameters to speech sounds by driving a set of digital filters in vocal tract simulator 75, to simulate the effect of the vocal tract. The voice source module 53, an aspiration source 61, and a frication source 69, supply the input to the filters of the vocal tract simulator 75. The aspiration source 61 represents air turbulence at the vocal cords. The frication source 69 represents the turbulence at another point of constriction in the vocal tract, usually involving the tongue. These two sources may be computationally obtained. However, the present invention uses a voice source which is derived from natural speech, containing frequency domain and time domain characteristics of natural speech.

There are other text-to-speech systems that use concatenation of units derived from natural speech. These units are usually around the size of a syllable; however, some methods have been devised with units as small as glottal pulses, and others with units as large as words. In general, these systems require a large database of stored units in order to synthesize speech. The present invention has similarities with these "synthesis by concatenation" systems; however, it considerably simplifies the database requirement by combining methods from "synthesis by rule." The requirement for storing a variety of vowels and phonemes is removed by inverse filtering. The vowel information can be reinserted by passing the source through a cascade of second order digital filters which simulates the vocal tract. The controls for the vocal tract filter or simulator 75 are separate modules which can be completely rule-based or partially based on natural speech.

In the synthesis by concatenation systems, complicated prosodic modification techniques must be applied to the concatenation units in order to impose the desired pitch contours. The voice source 53 utilized in the present invention easily produces a sequence of glottal pulses with the correct pitch as determined by the input pitch contour 55. Two preferred methods of pitch control will be described below. The input pitch contour is generated in the prosodic component 47 of the text-to-speech system shown in FIG. 6.

Figure 8:
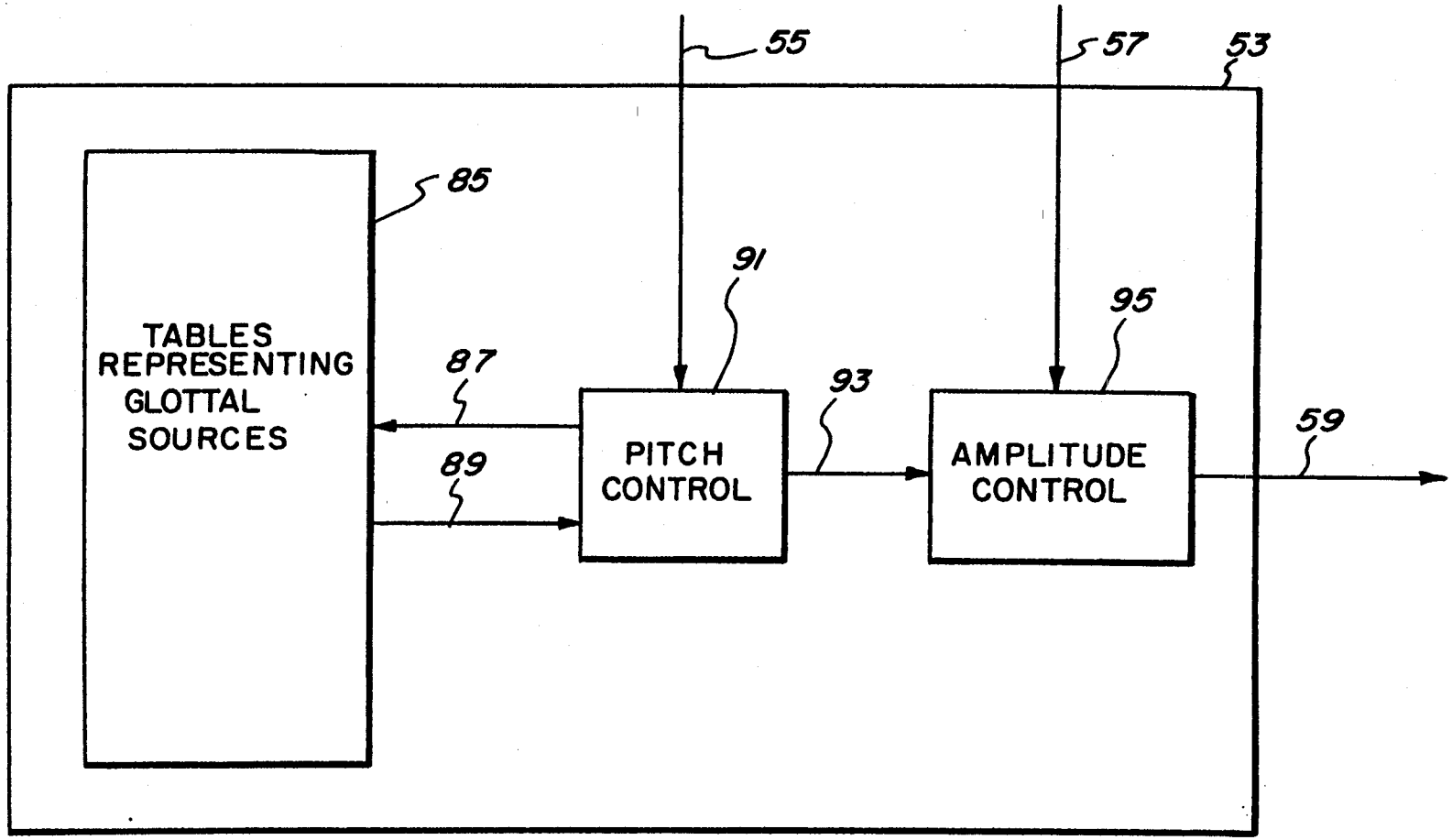
FIG. 8 is a preferred embodiment of the human voice source used in FIG. 7; P

The amplitude and duration of the voice source are easily controlled by modulation of the voice source by an amplitude envelope. The voice source module 53 of the present invention, as illustrated in FIG. 8, comprises a digital table 85 that represents the sampled voice, a pitch control module 91, and an amplitude control module 95.

The present invention contemplates two alternate preferred methods of pitch control, which will be called the "loop method" and the "concatenation method." Both methods use the voice of a human speaker.

Figure 9:
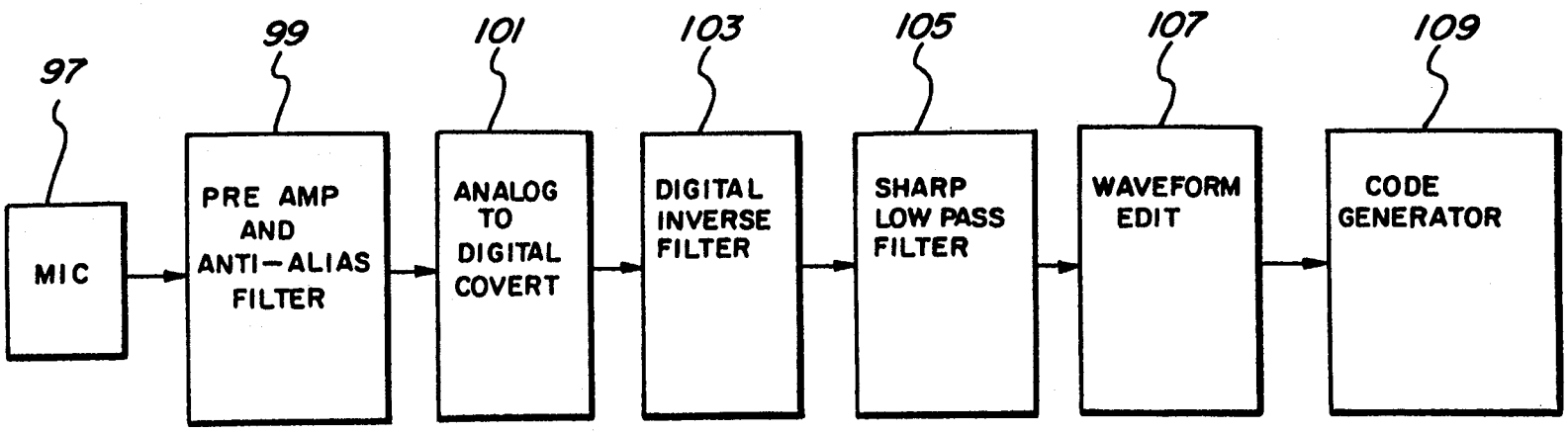
FIG. 9 is a block diagram of a system for extracting, recording, and storing a human voice source.

For the loop method, the voice of a human speaker is recorded in a sound treated room. The human speaker enunciates steady state vowels into a microphone 97 (FIG. 9). These signals are passed through a preamplifier and antialias filter 99 to a 16-bit analog-to-digital converter 101. The digital data is then filtered by digital inverse filters 103, which are several second order FIR filters.

These FIR filters are "zeros" chosen to cancel the resonances of the vocal tract. The use of the five zero filters is intended to match the five pole cascade formant filter used in the synthesizer. However, any inverse filter configuration may be used as long as the resulting sound is good. For example, an inverse filter with six zeros, or an inverse filter with zeros and poles may be used.

The data from the inverse filter 103 is segmented to contain an integral number of glottal pulses with constant amplitude and pitch. Five to ten glottal pulses are extracted. The waveforms are segmented at places that correspond to glottal closure by waveform edit 107. In order to avoid distortion, the signal from the digital inverse filter is passed through a sharp low pass filter 105 which is low pass at about 4.2 kilohertz and falls off 40 dB before 5 kilohertz. The effect is to reduce energy near the Nyquist rate, and thereby avoid aliasing that may have already been introduced, or may be introduced if the pitch goes too high. The output of waveform edit circuit 107 is supplied to a code generator 109 that produces the code for the digital table 85 (FIG. 8).

Figure 10:
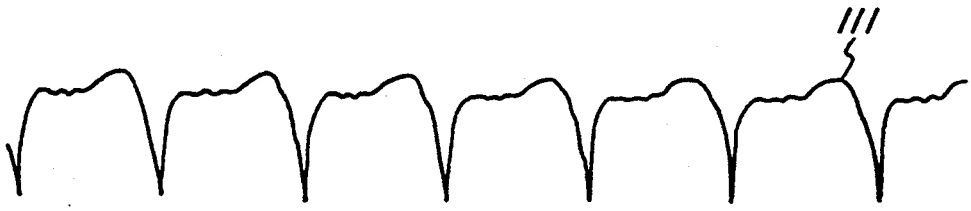
FIG. 10 is a waveform representing human derived glottal waves.

The digital inverse filter 103 removes the individual vowel information from the recorded vowel sound. An example of a wave output from the inverse filter is shown in FIG. 10 as wave 111. An interesting effect of removing the vowel information and other linguistic information in this manner is that the language spoken by the model speaker is not important. Even if the voice is that of a Japanese male speaker, it may be used in an English text-to-speech system. It will retain much of the original speaker's voice quality, but will sound like an English speaker. The inverse filtered speech wave 111 is then edited in waveform edit module 107 to an integral number of glottal pulses and placed in the table 85.

During synthesis, the table is sampled sequentially. When the end of the table is reached, the next point is taken from the beginning of the table, and so on.

To produce varying pitch, interpolation is performed within the table. The relation between the number of interpolated points and the points in the original table results in a change in pitch. As an example of how this loop pitch control method works, reference is made to the waveforms in FIGS. 11, 12, and 13.

Figure 11:
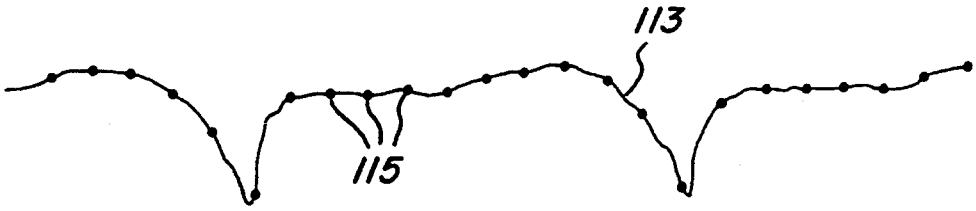
FIG. 11 is a waveform of a human derived glottal wave showing its digitized points.
Figure 12:
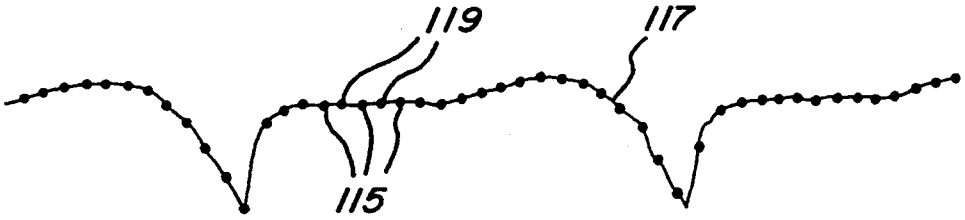
FIG. 12 is a waveform showing how the pitch of the wave in FIG. 11 is decreased.
Figure 13:
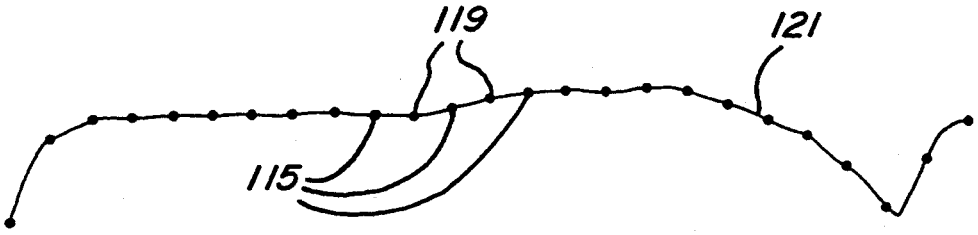
FIG. 13 shows the decreased pitch wave.

Assume that the original pitch of the voice stored in the table is at 200 Hertz and that it is originally sampled at 10 kilohertz at the points 115 on waveform 113, as shown in FIG. 11. To produce a frequency one-half that of the original, interpolated points 119 are added between each of the existing points 115 in the table, as shown in FIG. 12. Since the output sample rate remains at 10 kilohertz, the additional samples effectively stretch out the signal, in this case doubling the period and halving the frequency as shown by waveform 121 in FIG. 13.

Conversely, the frequency can be raised by taking fewer points. The table can be thought of as providing a continuous waveform which can be sampled periodically at different rates, depending on the desired pitch.

In order to prevent aliasing and unnatural sound caused by lowering the pitch too much, the pitch variability is preferably limited to a small range adjacent and below the pitch of the sample. In order to obtain a full range of pitches, several source tables, each covering a smaller range, may be utilized. To move from one table to another, the technique of cross-fading is utilized to prevent a discontinuity in sound quality.

A preferred cross-fading technique preferred is a linear cross-fade method that follows the relationship:

$$S.P. = A\ X_n + B\ Y_n$$

When moving from one table of glottal pulses to another, preferably the last 100 to 1,000 points in the departing table (X) and the first 100 to 1,000 points in the entering table (Y) are used in the formula to obtain the sample points (S.P.) that are utilized. The factors "A" and "B" are fractions which are chosen so that their sum is always "1." For ease of explanation, assume that the last 10 points in the departing table and the first 10 points of the entering table are used for cross-fading. For the tenth from last point in the departing table and the first point in the entering table:

$$S.P. = 0.9\ X_{10} + 0.1\ Y_1$$

This procedure is followed until for the last point in the departing table and the tenth point in the entering table:

$$0.1\ X_1 + 0.9\ Y_{10} + S.P.$$

In order to get a more natural sound, approximately five to ten glottal pulses are stored in the table 85. It has been found through experimentation that repeating only one glottal pulse in the loop method tends to create a machine-like sound. If only one pulse is used, the overall spectral shape may be right, but the naturalness from jitter and shimmer do not appear to be present.

An alternate preferred method, the concatenation method, is similar to the above method, except that interpolation is not the mechanism used to control pitch. Instead, a library of individual glottal pulses is stored in a memory, each with a different period. The glottal pulse that would appear to correspond to a current pitch value is the one accessed at any given time. This avoids the spectral shift and aliasing which may occur with the interpolation process.

Each glottal pulse in the library corresponds to a different integral number of sample points in the pitch period. Some of these can be left out in regions of pitch where the human ear could not hear the steps. When voicing at various pitches is being asked for, appropriate glottal pulses are selected and concatenated together as they are played.

Figure 14:
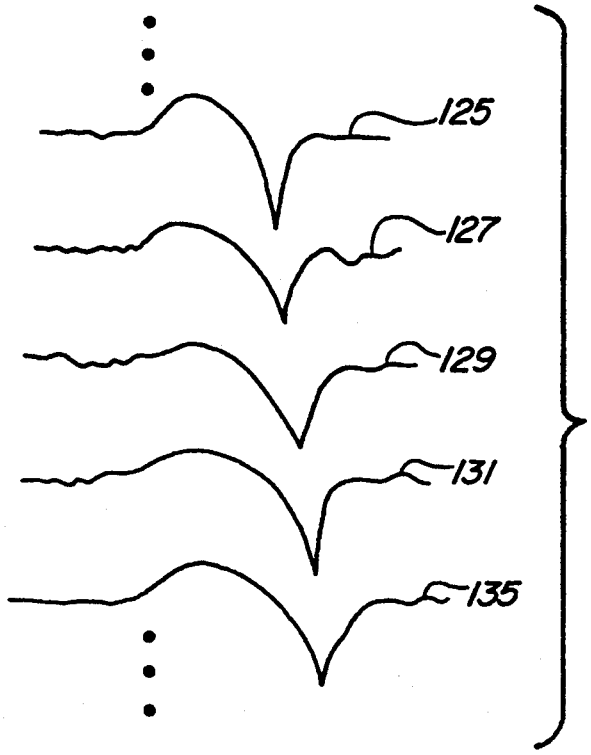
FIG. 14 is a series of individual glottal waves stored in memory to be joined together as needed.
Figure 15:
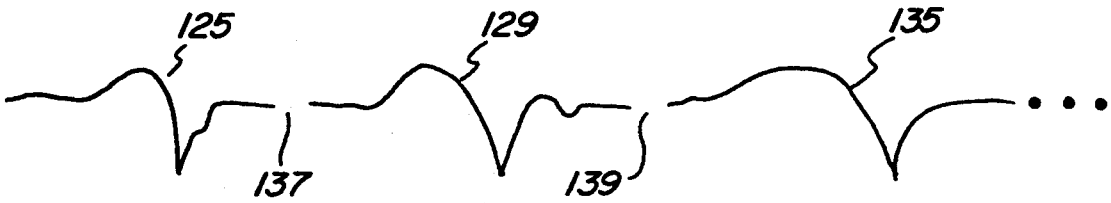
FIG. 15 is a series of individual glottal pulse waves selected from memory to be joined together.
Figure 16:
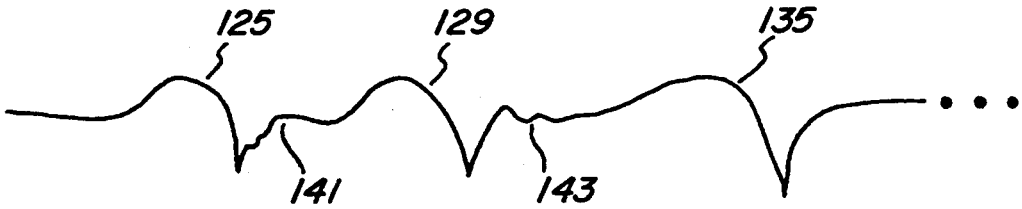
FIG. 16 is a single waveform resulting from the concatenation of the individual waves of FIG. 15.

This method is illustrated in FIGS. 14, 15, and 16. In FIG. 14, five different stored pulses, 125, 127, 129, 131, and 135, are shown, each differing in pitch. They are selected as needed, depending upon the pitch variation, and then joined together as shown in FIG. 16. In order to avoid discontinuities 137, 139 in the waveform, the glottal pulses are segmented at zero crossings, or effectively during the closed phase of the glottal wave. By storing one glottal pulse at each frequency, there are slight variations in shape and amplitude from sample to sample, such as between sample 125, 127, 129, 131, and 135. When these are concatenated together as shown in FIG. 16 with no discontinuities at connecting points 141, 143, these variations have an effect that is similar to jitter and shimmer, which gives the reproduced voice its natural sound.

To obtain the glottal pulses stored for the concatenation method, a human speaker enunciates normal speech into the microphone 97 (FIG. 9), in contrast to steady state vowels for the loop method. The normal speech is passed through the preamplifier and antialias filter 99, analog-to-digital filter 101, digital inverse filter 103, and waveform edit module 107, into code generator 109. The code generator produces the wave data stored in memory that represents the individual glottal pulses such as the five different glottal pulses 125, 127, 129, 131, and 135, for example.

In order to join the different glottal pulses together as needed in a smooth manner, the cross-fading technique described above should be utilized. Preferably the ending of one glottal pulse is faded into the beginning of the adjacent succeeding glottal pulse by overlapping the respective ending and beginning 10 points. The fading procedure would operate as explained above in the 10-point example.

In an extended version of the concatenation method, many glottal pulses varying in pitch (period), amplitude, and shape need to be stored. Approximately 250 to 1,000 different glottal pulses would be required. Each pulse will preferably be defined by approximately 200 bytes of data, requiring 50,000 to 200,000 bytes of storage.

The set of glottal pulses to be stored are selected statistically from a body of inverse filtered natural speech. The glottal pulses have lengths that vary with respect to their period. Each set of glottal pulses represents a particular speaker with a particular speaking style.

Because we are only storing a set of glottal pulses, using a statistical selection process ensures that more glottal pulses are available for denser areas. This means that an adequate representative glottal pulse would be available during the selection process. The selection process is preferably based on the relevant parameters of period, amplitude, and the phoneme represented. Several different and alternately preferred methods of selecting the best glottal pulse at each moment of the synthesis process may be used.

One method uses a look-up table containing a plurality of addresses, each address selecting a certain glottal pulse stored in memory. The look-up table is accessed by a combination of the parameters of period (pitch), amplitude, and phonemes represented. For an average size representation, the table would have about 100,000 entries, each entry having a byte or eight-bit address to a certain glottal pulse. A table of this size would provide a selectability of 100 different periods, each having 20 different amplitudes, each in turn representing 50 different phonemes.

Another better method involves storing a little extra information with each glottal pulse. The human anatomical apparatus operates in slow motion compared to electronic circuits. Normal speech changes from dark, sinusoidal-type sounds to brighter, spikey-type sounds with transition. This means that normal speech produces adjacent glottal pulses that are similar in spectrum and waveform. Out of a set of ~500 glottal pulses, chosen as described above, there are only about 16 glottal pulses that could reasonably be neighbors for a particular pulse. "Neighbor," in this context, means close in spectrum and waveform.

Stored with each glottal pulse of the full set is the location of 16 of its possible neighbors. The next glottal pulse to be chosen would come out of this subset of 16. Each of these 16 would be examined to see which would be the best candidate. Besides this "neighbor" information, each glottal pulse would carry information about itself, like its period, its amplitude, and the phoneme that it represents. This additional information would only require about 22 bytes of additional storage. Each of the 16 "neighbor" glottal pulses would require 1 byte for a storage address, 16 bytes. One byte for period, one byte for amplitude, and four bytes for phonemes represented would bring the total storage required to 22 bytes.

Another glottal selecting process involves the storing of a linking address with each glottal pulse. For any given period there would normally only be 10 to 20 glottal pulses that would reasonably fit the requirements. Addressing any one of the glottal pulses in this subset will also provide the linking address to the next glottal pulse in the subset. In this manner, only the 10 to 20 glottal pulses in the subset are examined to determine the best fit, rather than the entire set.

What is claimed is:

1. In a synthetic voice generating system, the improvement therein comprising:

a plurality of glottal pulses, each glottal pulse having a different desired frequency and being a selected portion of a speech waveform, said speech waveform being created by measuring sound pressures of a human spoken sound at successive sample points in time and inverse-filtering the measurements to remove vocal tract components;

storage means for storing said plurality of glottal pulses; and means for utilizing said plurality of glottal pulses to generate a synthetic voice signal.

2. The improvement in said synthetic voice generating system of claim 1 wherein said storage means comprises:

a memory look-up table containing a plurality of sample points for each one of said glottal pulses.

3. The improvement in said synthetic voice generating system of claim 2 wherein said means for utilizing comprises:

pitch control means for modifying said glottal pulses to vary the pitch of the glottal pulses, said glottal pulses being modified by uniformly interpolating between sample points of said glottal pulses to produce a modified glottal pulse having more or fewer sample points.

4. The improvement in said synthetic voice generating system of claim 3 wherein said means for utilizing further comprises:

amplitude control means for increasing or decreasing the amplitude of the time-domain glottal pulses modified by said pitch control means.

5. The improvement in said synthetic voice generating system of claim 1 wherein said storage means comprises:

a memory means for storing a plurality of glottal pulses in time-domain form, each glottal pulse having therefor a different pitch period.

6. The improvements in said synthetic voice generating system of claim 5 wherein said means for utilizing comprises:

pitch control means for selecting a particular sequence of glottal pulses and concatenating them together.

7. The improvements in said synthetic voice generating system of claim 6 wherein said means for utilizing further comprises:

amplitude control means for increasing or decreasing the amplitude of the time-domain glottal pulses concatenated by said pitch control means.

8. In a synthetic voice generating system, the improvement therein comprising:

a plurality of glottal pulses stored in a storage means, each glottal pulse having a desired frequency and being a selected portion of a speech waveform, said speech waveform being created by measuring sound pressures of a human spoken sound at successive sample points in time and inverse-filtering the measurements to remove vocal tract components;

a voice source means for generating a signal representing the sound produced by a human larynx by combining a plurality of said stored glottal pulses; and a vocal tract simulating means for modifying the signals from said voice source means to simulate the effect of a human vocal tract on said voice source signals.

9. The improvement of claim 8 wherein said vocal tract simulating means comprises:

a cascade of second order digital filters.

10. The improvement of claim 9 wherein besides said voice source signal, said digital filters receive signals from a noise source means which generates signals representing air turbulence in the voice tract.

11. The improvement of claim 10 wherein said noise source means comprises:

an aspiration source means for generating signals representing air turbulence at the vocal cords; and a frication source means using frications from real speech for generating signals representing air turbulence in vocal cavities of the pharynx, mouth and nose.

12. The improvements of claim 8 wherein the voice source means comprises:

storage means for storing a plurality of different time domain glottal pulses derived from a human source; and means for utilizing the glottal pulses in said storage means to generate a synthetic voice signal.

13. The improvement of claim 12 wherein said storage means comprises:

a plurality of memory look-up tables, each table containing a plurality of sample points representing a small group of glottal pulses, in code form.

14. The improvement of claim 13 wherein said utilizing means comprises:

means for cross-fading between a departing memory look-up table and in entering memory look-up table according to the relation:

$$S.P. = A\,X_n + B\,Y_n$$

wherein A and B are fractions that total 1, $X_n$ is a sample point near the end of the departing look-up table, $Y_n$ is a sample point near the beginning of the entry look-up table, and S.P. is the resulting sample point.

15. The improvement of claim 12 wherein said storage means comprises:

a memory look-up table containing a plurality of sample points for each one of said time domain glottal pulses.

16. The improvement of claim 15 wherein said utilizing means comprises:

pitch control means for modifying said glottal pulses by varying the pitch period of each glottal pulse by uniformly interpolating between the sample points of a selected glottal pulse to produce a modified glottal pulse having more sample points.

17. The improvement of claim 16 wherein said utilizing means further comprises:

amplitude control means for increasing or decreasing the amplitude of the time-domain glottal pulses modified by said pitch control means.

18. The improvement of claim 17 wherein said vocal tract simulating means comprises a cascade of second order digital filters.

19. The improvement of claim 18 wherein besides said voice source signal, said digital filters receive signals from a noise source means which generates signals representing air turbulence in the voice tract.

20. The improvement of claim 19 wherein said one noise source means comprises:

an aspiration source means for generating signals representing air turbulence at the vocal cords; and a frication source means using frications from real speech for generating signals representing air turbulence in vocal cavities of the pharynx, mouth and nose.

21. The improvement of claim 12 wherein said storage means comprises:

a memory means for storing a plurality of glottal pulses in time-domain form, each glottal pulse having a different pitch period.

22. The improvement of claim 21 wherein said utilizing means comprises:

pitch control means for selecting a particular sequence of glottal pulses and concatenating them together.

23. The improvement of claim 22 wherein said utilizing means further comprises:

means for cross-fading between an ending glottal pulse and a beginning glottal pulse to be concatenated together, according to the relation:

$$S.P. = A\,X_n + B\,Y_n$$

wherein A and B are fractions that always total 1, $X_n$ is a point on the ending glottal pulse to be joined to the beginning glottal pulse, $Y_n$ is a point on the beginning glottal pulse, and S.P. is the resulting sample point which is a combination of the ending glottal pulse and the beginning glottal pulse.

24. The improvement of claim 22 wherein said means for utilizing further comprises:

amplitude control means for increasing or decreasing the amplitude of the glottal pulses concatenated by said pitch control means.

25. The improvement of claim 24 wherein said vocal tract simulating means comprises a cascade of second order digital filters.

26. The improvement of claim 25 wherein besides said voice source signal, said digital filters receive signals from a noise source means which generates signals representing air turbulence in the voice tract.

27. The improvement of claim 26 wherein said one noise source means comprises:

an aspiration source means for generating signals representing air turbulence at the vocal cords; and a frication source means using frications from real speech for generating signals representing air turbulence in vocal cavities of the pharynx, mouth and nose.

28. The improvement of claim 12 wherein said storage means comprises:

a memory means for storing a plurality of glottal pulses in code form.

29. The improvement of claim 28 wherein said utilizing means comprises:

pitch control means for selecting a particular sequence of glottal pulses and concatenating them together.

30. The improvement of claim 29 further comprising an address look-up table for said memory means, said address look-up table providing addresses to certain glottal pulses stored in said memory means in response to the parameters of period and amplitude.

31. The method of claim 30, further comprising, after said measuring step, the step of filtering the measured human speech sounds by an antialias filter.

32. The improvement of claim 29 wherein said memory means stores the addresses of a plurality of other possible neighbor glottal pulses along with each glottal pulse stored, whereby only the neighbor glottal pulses are selected for concatenating with said stored glottal pulse.

33. The improvement of claim 32 wherein said utilizing means further comprises:

means for cross-fading between a selected ending glottal pulse and a selected beginning glottal pulse to be concatenated together, according to the relation:

$$S.P. = A\,X_n + B\,Y_n$$

wherein A and B are functions that always total 1, $X_n$ is a point on the ending glottal pulse, $Y_n$ is a point on the beginning glottal pulse, and S.P. is the resulting sample point which is a combination of the ending and beginning glottal pulses.

34. The improvement of claim 29 wherein said memory means stores the address of one other glottal pulse along with each glottal pulse stored, effectively providing a list of glottal pulses, whereby the stored glottal pulses and the list of glottal pulses are examined to determine which one best meets the requirement.

35. The improvement of claim 34 wherein said utilizing means further comprises:

means for cross-fading between a selected ending glottal pulse and a selected beginning glottal pulse to be concatenated together, according to the relation:

$$S.P. = A\,X_n + B\,Y_n$$

wherein A and B are fractions that always total 1, $X_n$ is a point on the ending glottal pulse, $Y_n$ is a point on the beginning glottal pulse, and S.P. is the resulting sample point which is a combination of the starting and beginning glottal pulses.

36. The improvement of claim 29 further comprising an address look-up table for said memory means, said address look-up table providing addresses to certain glottal pulses stored in said memory means in response to the parameters of period, amplitude, and phoneme.

37. In a synthetic voice generating system, the improvement therein comprising:

a plurality of glottal pulses said glottal pulses having different desired frequencies and being a selected portion of an inverse-filtered human speech waveform;

storage means for storing said glottal pulses;

means for retrieving said glottal pulses from said storage means; and means for applying said glottal pulses to a synthesis filter to generate a synthetic voice signal.

38. The improved synthetic noise generating system of claim 37 wherein said speech waveform is created by measuring the sound pressure of a human spoken sound at successive points in time.

39. The improved synthetic voice generating system of claim 38 wherein said vocal tract components are removed by inverse filtering.

40. In a synthetic voice generating system, the improvement comprising:

a plurality of stored glottal pulses, each stored glottal pulse having a desired frequency and being a selected portion of a speech waveform, said speech waveform created by measuring sound pressures of a human spoken sound at successive sample points in time and inverse-filtering the measurements to remove vocal tract components;

a noise source means for generating a signal representing the sound produced by a human larynx by combining a plurality of said stored glottal pulses; and a vocal tract simulating means for modifying the signals from said noise source means to simulate the effect of a human vocal tract on said noise source signals.

41. The improved synthetic noise generating system of claim 40 wherein said speech waveform is created by measuring the sound pressure of a human spoken sound at successive points in time.

42. The improved synthetic voice generating system of claim 40 wherein said vocal tract components are removed by inverse filtering.

43. In a synthetic voice generating system, the improvement therein comprising:

a plurality of glottal pulses in a storage means, said pulses comprising portions of glottal waveforms generated by inverse filtering time-domain representations of human speech with a plurality of second-order, finite-impulse-response filters with zeros chosen to cancel human vocal tract resonance components therefrom, each of said plurality of glottal pulses having a desired frequency and including frequency domain and time domain characteristics of human speech;

pitch control means for receiving said plurality of glottal pulses and generating pitch-modified glottal pulses;

amplitude control means for receiving said pitch-modified glottal pulses and increasing or decreasing an amplitude of said pitch-modified glottal pulses to generate amplitude-modified glottal pulses; and vocal tract simulating means for modifying said amplitude-modified glottal pulses received from said amplitude control means to simulate human vocal tract resonances on said amplitude-modified glottal pulses.

44. A method of generating speech comprising the steps of:

extracting glottal pulses from speech, each glottal pulse having a different frequency;

storing said glottal pulses in a memory;

reading said glottal pulses from said memory; and applying the glottal pulses read from memory to a synthesis filter for outputting speech.

45. The method of generating speech according to claim 44, wherein the step of storing the glottal pulses includes a step of storing at least one glottal pulse for each desired frequency.

46. A method of generating synthetic speech having various pitches from inverse-filtered speech waveforms, comprising the following steps:

reading a first glottal pulse from a memory containing a plurality of glottal pulses, each stored glottal pulse having a different period, said first glottal pulse having a first period that corresponds to a first desired pitch;

reading a second glottal pulse from said memory, said second glottal pulse having a second period that corresponds to a second desired pitch;

concatenating the two glottal pulses to form a resulting waveform; and applying the resulting waveform to a synthesis filter to generate speech with varying pitch.

47. The method of generating synthetic speech according to claim 46, wherein the step of concatenating the two glottal pulses includes the step of segmenting the two glottal pulses at zero crossings and joining the two pulses at the segmentation.

* * * * *